US009422943B2

(12) United States Patent
Horng

(10) Patent No.: US 9,422,943 B2
(45) Date of Patent: Aug. 23, 2016

(54) CENTRIFUGAL FAN

(71) Applicant: SUNON ELECTRONICS (KUNSHAN) CO., LTD., Kunshan, Jiangsu (CN)

(72) Inventor: Alex Horng, Kaohsiung (TW)

(73) Assignee: Sunon Electronics (Kunshan) Co., Ltd., Kunshan (CN)

( * ) Notice: Subject to any disclaimer, the term of this patent is extended or adjusted under 35 U.S.C. 154(b) by 415 days.

(21) Appl. No.: 14/010,779

(22) Filed: Aug. 27, 2013

(65) Prior Publication Data

US 2014/0086762 A1 Mar. 27, 2014

(30) Foreign Application Priority Data

Sep. 25, 2012 (TW) ..... 101135129 A

(51) Int. Cl.

| | |
|---|---|
| ***F04D 29/44*** | (2006.01) |
| ***F04D 29/42*** | (2006.01) |
| ***F04D 25/06*** | (2006.01) |
| ***F04D 29/62*** | (2006.01) |

(52) U.S. Cl.

CPC ..... *F04D 29/4226* (2013.01); *F04D 25/0613* (2013.01); *F04D 29/626* (2013.01)

(58) Field of Classification Search

USPC ..... 415/89, 120, 203, 204, 206; 416/175, 416/185, 186 R, 187, 203

See application file for complete search history.

(56) References Cited

U.S. PATENT DOCUMENTS 6,460,608 B1 10/2002 Katsui
7,351,031 B2 * 4/2008 Horng ..... F04D 17/16 415/206
7,458,415 B2 * 12/2008 Hashimoto ..... F04D 29/30 165/104.21
8,508,939 B2 * 8/2013 Takahasi ..... F04D 25/08 361/679.49
8,619,423 B2 * 12/2013 Kim ..... B04C 3/00 361/694
8,717,762 B2 * 5/2014 Fujiwara ..... F04D 25/068 361/694
8,881,794 B2 * 11/2014 Walsh ..... F04D 29/582 165/104.34
8,992,175 B2 * 3/2015 Heli ..... F04D 25/0613 415/121.2
2002/0167799 A1 11/2002 Kawashima et al.
2011/0073280 A1 3/2011 Liu et al.
2012/0032542 A1 2/2012 Liu et al.

FOREIGN PATENT DOCUMENTS

CN 2714860 Y 8/2005

* cited by examiner

*Primary Examiner* — Binh Q Tran
(74) *Attorney, Agent, or Firm* — Alan D. Kamrath; Kamrath IP Lawfirm, P.A.

(57) ABSTRACT

A centrifugal fan includes a fan frame, a motor, an impeller and an axial positioning member. The fan frame includes a base plate portion, a cover plate portion, and a lateral wall portion arranged between the base plate portion and the cover plate portion. The cover plate portion includes an air inlet, and the lateral wall portion includes an air outlet. The motor is received in the fan frame. The impeller is rotatably coupled with the motor. The axial positioning member is arranged along a path surrounding the air inlet of the fan frame. The axial positioning member includes a coupling face and an abutting face opposite to the coupling face. The coupling face is coupled with the cover plate portion of the fan frame. The abutting face is spaced from the coupling face.

13 Claims, 5 Drawing Sheets

CENTRIFUGAL FAN

BACKGROUND OF THE INVENTION

1. Field of the Invention

The present invention generally relates to a centrifugal fan and, more particularly, to a centrifugal fan capable of drawing air via an axial air inlet as well as expelling air via a radial air outlet.

2. Description of the Related Art

Conventional cooling fans generally include axial fans and centrifugal fans. The axial fan has an axial air inlet and an axial air outlet opposite to the axial air inlet in an axial direction thereof. Air can be drawn into the axial fan via the axial air inlet and then expelled via the axial air outlet, providing a desired cooling function. The centrifugal fan has an axial air inlet in an axial direction and a radial air outlet in a radial direction thereof. Air can be drawn into the centrifugal fan via the axial air inlet and then expelled via the radial air outlet for cooling purposes.

Due to the fact that the axial fan drives air in the axial direction rather than in the radial direction during the cooling operation, the axial fan must be mounted on a top of a heat source (such as on a top face of a CPU of a computer) when installed in an electronic device, making it difficult to reduce the height of the electronic device.

In addition, since the centrifugal fan expels air in the radial air outlet, the centrifugal fan does not need to be mounted on a top of a heat source. As such, the centrifugal fan can be installed in various mini-sized electronic devices with limited interior spaces. However, since the interior space of the mini-sized electronic device is limited, some problems are encountered, as stated below.

First, the centrifugal fan has an unsatisfied cooling effect and a shortened service life. Specifically, if the axial air inlet of the centrifugal fan is too close to an inner wall of the electronic device (or to any interior structures of the electronic device) when the centrifugal fan is installed in the electronic device, air cannot be smoothly drawn into the fan via the axial air inlet, and noise easily results, affecting the cooling effect and shortening the, service life of the centrifugal fan.

Second, it is difficult to miniaturize the electronic device. Specifically, if the axial air inlet of the centrifugal fan is spaced from the inner wall of the electronic device (or spaced from any interior structure of the electronic device) by a large distance (i.e. larger than the proper distance) when the centrifugal fan is installed in the electronic device, the centrifugal fan tends to occupy a large space in the electronic device despite the fact that air can be smoothly drawn into the fan via the axial air inlet. As a result, the size of the electronic device cannot be reduced.

SUMMARY OF THE INVENTION

It is therefore the objective of this invention to provide a centrifugal fan that is able to smoothly draw air without requiring a large installation space in the electronic device, providing an improved cooling effect.

In a preferred embodiment, a centrifugal fan including a fan frame, a motor, an impeller and an axial positioning member is disclosed. The fan frame includes a base plate portion, a cover plate portion, and a lateral wall portion arranged between the base plate portion and the cover plate portion. The cover plate portion includes an air inlet, and the lateral wall portion includes an air outlet. The motor is received in the fan frame. The impeller is rotatably coupled with the motor. The axial positioning member is arranged along a path surrounding the air inlet of the fan frame. The axial positioning member includes a coupling face and an abutting face opposite to the coupling face. The coupling face is coupled with the cover plate portion of the fan frame. The abutting face is spaced from the coupling face.

In a preferred form shown, the fan frame has a first height in an axial direction of the fan frame, and the axial positioning member has a second height in the axial direction of the fan frame. The second height is 20% to 80% of the first height. In a further preferred case, the second height is 40% to 60% of the first height.

In the preferred form shown, the axial positioning member comprises a plurality of posts.

In the preferred form shown, the posts are arranged along a path surrounding the air inlet of the fan frame. The posts are spaced from each other by a plurality of gaps, and the plurality of gaps forms a plurality of lateral air inlets.

In the preferred form shown, the axial positioning member comprises a first barrier and a second barrier opposing the first barrier.

In the preferred form shown, the first and second barriers are arranged along the path surrounding the air inlet of the fan frame. Both the first and second barriers include a first end and a second end. An opening is formed between the first ends of the first and second barriers, and another opening is formed between the second ends of the first and second barriers. The two openings of the first and second barriers form two lateral air inlets.

In the preferred form shown, the first barrier is aligned with the air outlet of the fan frame in the radial direction of the fan frame. An intake area is formed between the two openings and over the air inlet. The first barrier is positioned between the intake area and the air outlet of the fan frame in the radial direction of the fan frame.

In the preferred form shown, the axial positioning member comprises at least one post and at least one barrier.

In the preferred form shown, the at least one post and the at least one barrier are arranged along the path surrounding the air inlet of the fan frame.

In the preferred form shown, the axial positioning member comprises a lateral wall surrounding the air inlet of the fan frame. The lateral wall forms an opening which acts as a lateral air inlet.

In the preferred form shown, the lateral wall is aligned with the air outlet of the fan frame in the radial direction of the fan frame, and the lateral wall is located between the opening and the air outlet.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
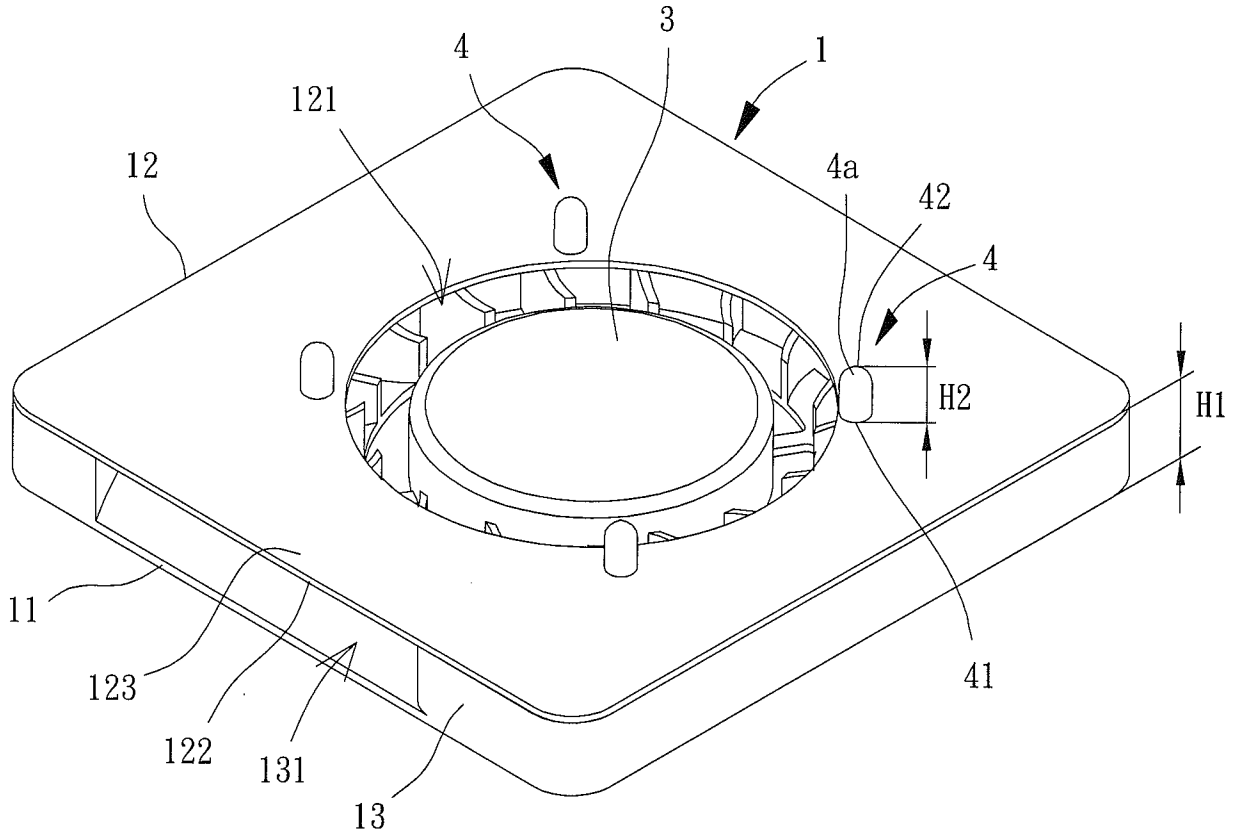
FIG. 1 shows a centrifugal fan according to a preferred embodiment of the invention.

In the various figures of the drawings, the same numerals designate the same or similar parts. Furthermore, when the terms “first”, “second”, “third”, “fourth”, “inner”, “outer”, "top", "bottom", "front", "rear" and similar terms are used hereinafter, it should be understood that these terms have reference only to the structure shown in the drawings as it would appear to a person viewing the drawings, and are utilized only to facilitate describing the invention.

DETAILED DESCRIPTION OF THE INVENTION

Figure 2:
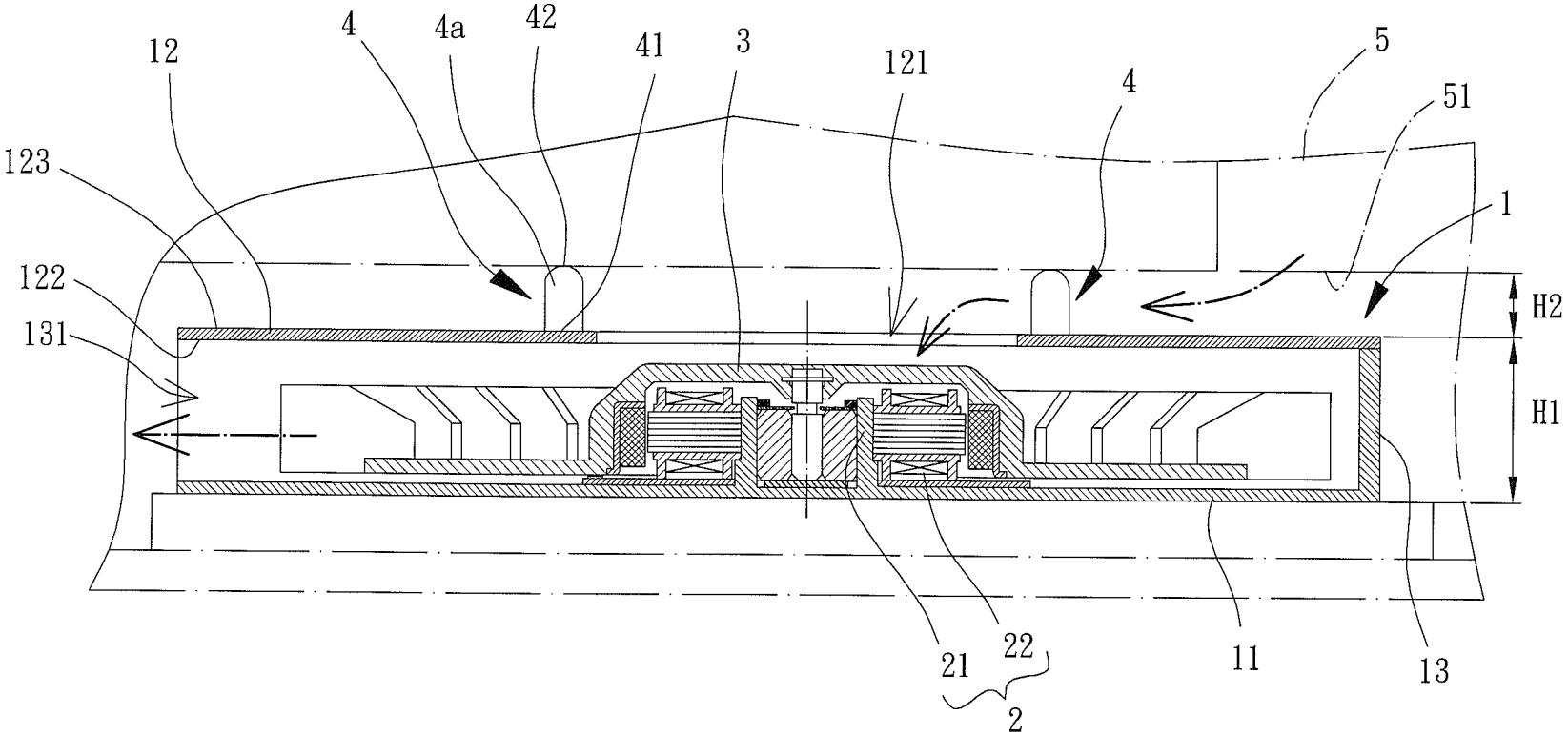
FIG. 2 is a cross-sectional view of the centrifugal fan of the preferred embodiment of the invention.

Referring to FIGS. 1 and 2, a centrifugal fan is disclosed according to a preferred embodiment of the invention. The centrifugal fan includes a fan frame 1, a motor 2, an impeller 3 and at least one axial positioning member 4. The fan frame 1 is of a structure capable of drawing air in an axial direction and expelling air in a radial direction of the fan frame 1. The motor 2 is installed in the fan frame 1. The impeller 3 is rotatably coupled with the motor 2, so that the motor 2 is able to drive the impeller 3 to rotate. The at least one axial positioning member 4 is coupled with the fan frame 1 to ensure that sufficient air can be guided into the fan frame 1.

The fan frame 1 is of a hollow frame in which the motor 2 and the impeller 3 can be received. The hollow frame may be in various geometric shapes, such as a polygonal shape, a round shape, an oval shape, etc. In this embodiment, the fan frame 1 has a rectangular shape.

The fan frame 1 has a first height H1 in the axial direction of the fan frame 1. In the embodiment, the fan frame 1 comprises a base plate portion 11 and a cover plate portion 12 spaced from the base plate portion 11 by a distance. The distance allows a lateral wall portion 13 to be arranged between the base plate portion 11 and the cover plate portion 12. The base plate portion 11, the cover plate portion 12 and the lateral wall portion 13 can be coupled and formed in any manner without limitations. In this embodiment, the lateral wall portion 13 is formed on an outer periphery of the base plate portion 11 in an integral injection molding. The cover plate portion 12 is in the form of a cover plate that can be affixed to and detached from the lateral wall portion 13.

The cover plate portion 12 of the fan frame 1 includes an air inlet 121. As shown in FIG. 2, the cover plate portion 12 further includes an inner face 122 facing an interior of the fan frame 1, as well as an outer face 123 facing away from the interior of the fan frame 1. The lateral wall portion 13 includes an air outlet 131. In this arrangement, a fan frame of a centrifugal fan is formed. The positions and quantities of the air inlet 121 and the air outlet 131 can be changed based on different requirements. In this embodiment, the first height H1 refers to a distance between the outer face 123 of the cover plate portion 12 and a bottom face of the base plate portion 11. The bottom face of the base plate portion 11 refers to the face of the base plate portion 11 that faces away from the cover plate portion 12.

The motor 2 is installed between the base plate portion 11 and the cover plate portion 12 in the fan frame 1. The motor 2 can be of any structure capable of driving the impeller 3 to rotate after the impeller 3 is coupled with the motor 2. Referring to FIG. 2, the motor 2 includes a shaft seat 21 and a coil unit 22. The shaft seat 21 can be affixed to or integrally formed on the base plate portion 11 of the fan frame 1. The coil unit 22 (which can include components such as a plurality of silicon steel plates, a coil, an insulation bobbin, etc.) surrounds the shaft seat 21 and is electrically connected to a driving circuit (not shown). The driving circuit and the coil unit 22 are used together to drive the impeller 3 to rotate.

The impeller 3 is rotatably coupled with the motor 2. In this embodiment, the impeller 3 is rotatably coupled with the shaft seat 21 of the motor 2 and is preferably installed in the fan frame 1.

The at least one axial positioning member 4 is arranged along a path surrounding the air inlet 121. Each axial positioning member 4 includes a coupling face 41 and an abutting face 42 opposite to the coupling face 41. The coupling face 41 is coupled with the cover plate portion 12 of the fan frame 1 (by affixing or integral formation). The abutting face 42 is spaced from the coupling face 41. Specifically, the abutting face 42 of the axial positioning member 4 is spaced from the outer face 123 of the cover plate portion 12 by a second height H2 in the axial direction of the fan frame 1. In this embodiment, the second height H2 may be 20% to 80% of the first height H1. In a preferred case, the second height H2 is 40% to 60% of the first height H1. In this arrangement, when the centrifugal fan is installed in an electronic device 5 (as shown in FIG. 2), it may be ensured that the air inlet 121 is spaced from an inner wall 51 of the electronic device 5 by a proper distance under the arrangement of the at least one axial positioning member 4 (the details are described later).

Specifically, the at least one axial positioning member 4 may be implemented in various ways, as stated below.

In a first implementation shown in FIG. 2, the at least one axial positioning member 4 is in the form of a plurality of posts 4*a* annularly arranged along the path surrounding the air inlet 121. The posts 4*a* are spaced from each other by a plurality of gaps. The plurality of gaps can form a plurality of lateral air inlets when the centrifugal fan is installed in the electronic device 5.

Figure 3:
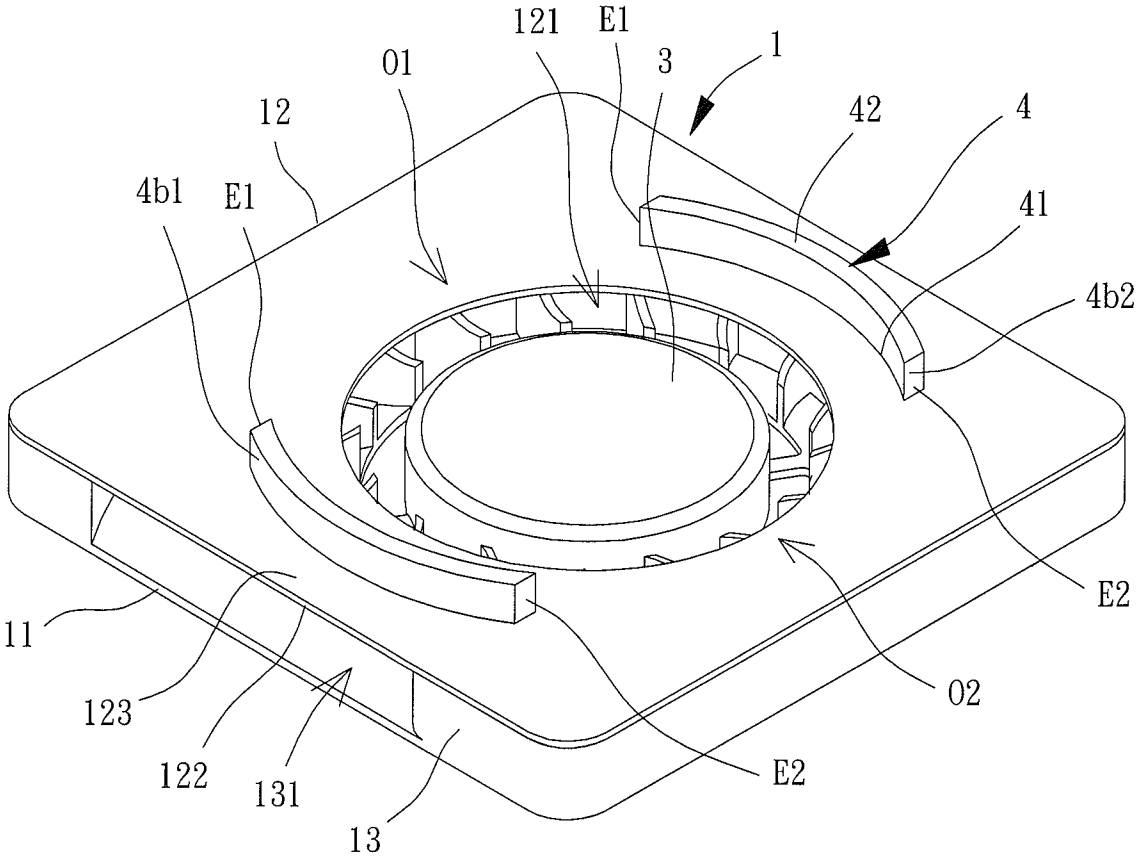
FIG. 3 shows another centrifugal fan according to another embodiment of the invention.

In a second implementation shown in FIG. 3, the at least one axial positioning member 4 includes a first barrier 4*b*1 and a second barrier 4*b*2 opposing the first barrier 4*b*1. The first and second barriers 4*b*1 and 4*b*2 are arranged along the path surrounding the air inlet 121. Both the first and second barriers 4*b*1 and 4*b*2 include a first end E1 and a second end E2. An opening O1 is formed between the first ends El of the first and second barriers 4*b*1 and 4*b*2. Similarly, another opening O2 is formed between the second ends E2 of the first and second barriers 4b1 and 4b2. The two openings O1 and O2 of the first and second barriers 4*b*1 and 4*b*2 face each other and may form two lateral air inlets when the centrifugal fan is installed in the electronic device 5. The first barrier 4*b*1 is preferably aligned with the air outlet 131 in the radial direction of the fan frame 1. In addition, an intake area is formed between the two openings O1 and O2 and over the air inlet 121. In this arrangement, the first barrier 4*b*1 is positioned between the intake area and the air outlet 131. In this arrangement, when the impeller 3 drives air to a heat source through the air outlet 131 for cooling purposes, it can be ensured that the outgoing air will not flow back to the air inlet 121 under the obstruction of the first barrier 4*b*1. Advantageously, the air-drawing effect of the air inlet 121 is not affected.

Figure 4:
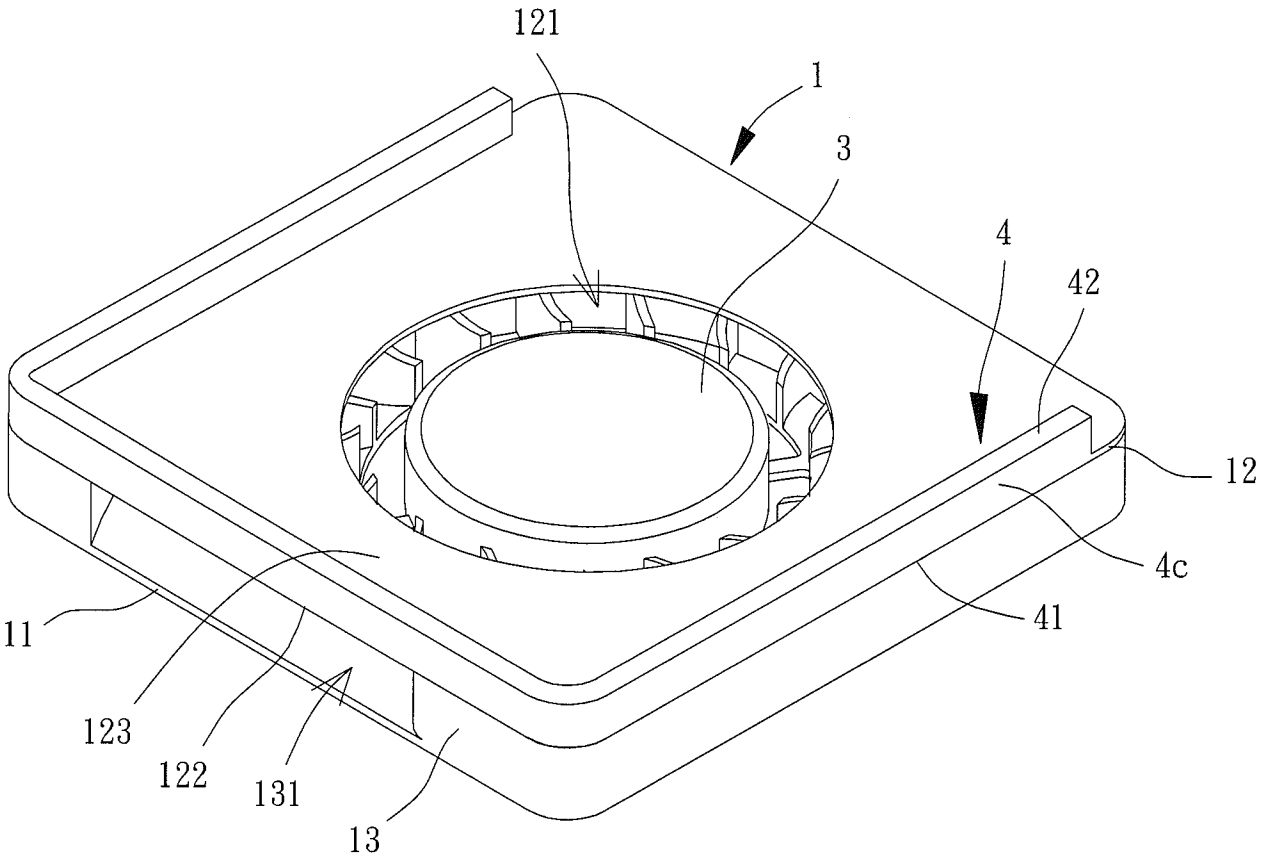
FIG. 4 shows yet another centrifugal fan of the invention.

In a third implementation shown in FIG. 4, the at least one axial positioning member 4 is in the form of a lateral wall 4*c* that is integrally formed on and extends from an outer periphery of the cover plate portion 12. The lateral wall 4*c* surrounds the air inlet 121 and forms an opening. When the centrifugal fan is installed in the electronic device 5, the opening may act as a lateral air inlet. In addition, the lateral wall 4*c* is preferably aligned with the air outlet 131 of the fan frame 1 to position the lateral wall 4*c* between the opening and the air outlet 131. In this arrangement, when the impeller 3 drives air to a heat source through the air outlet 131 for cooling purpose, it can be ensured that the outgoing air will not flow back to the air inlet 121 under the obstruction of the lateral wall 4*c*. Advantageously, the air-drawing effect of the air inlet 121 is not affected.

Figure 5:
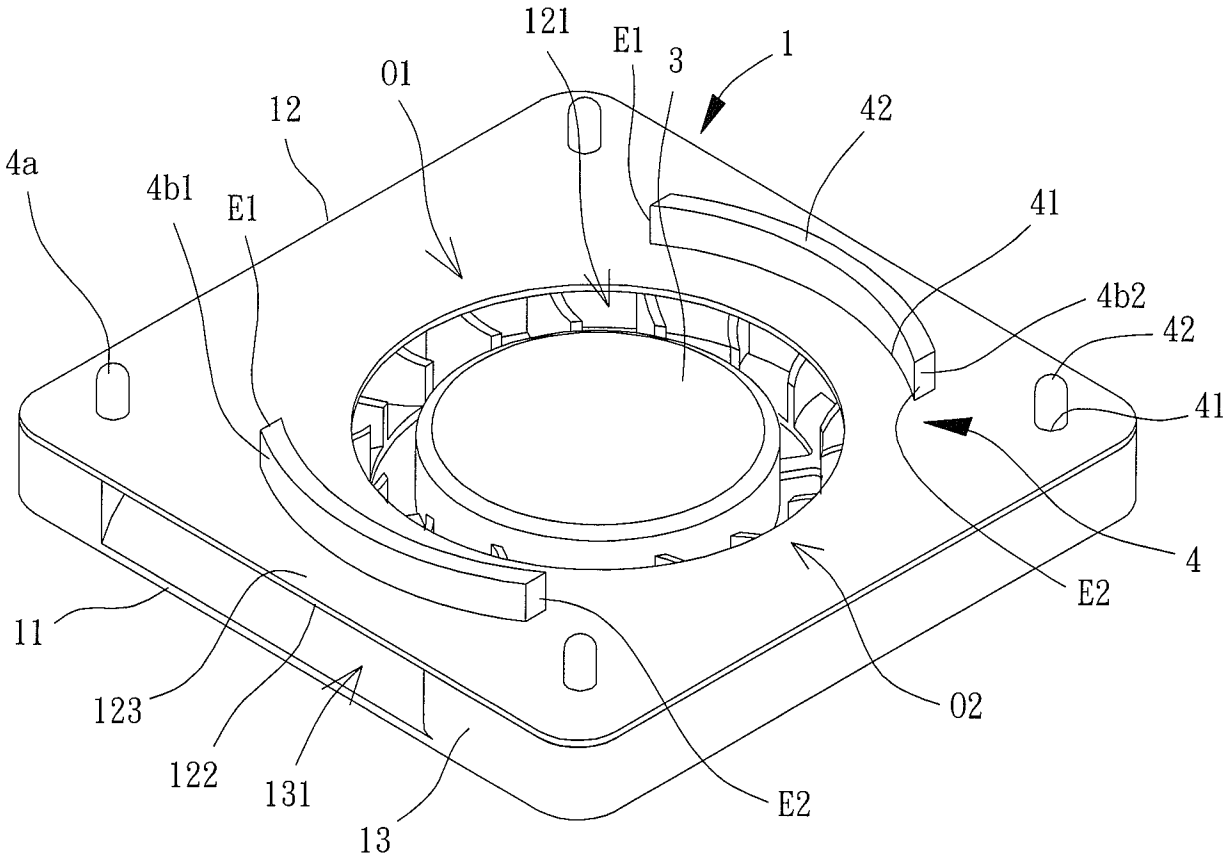
FIG. 5 shows yet another centrifugal fan of the invention.

Furthermore, the posts 4*a*, the barrier 4*b*1/4*b*2 and the lateral wall 4*c* can be used together. As an example, referring to FIG. 5, the at least one axial positioning member 4 includes a plurality of posts 4*a* and two barriers 4*b*1 and 4*b*2. The plurality of posts 4*a* and the barriers 4*b*1 and 4*b*2 surround the air inlet 121 of the fan frame 1 to achieve the same advantages described above.

Referring to FIG. 2 again, when the centrifugal fan is installed in the electronic device 5, the air outlet 131 faces the heat source (the heat source is the component that generates a large amount of heat during the operation of the electronic device 5) and the at least one axial positioning member 4 abuts with the inner wall 51 of the electronic device 5 (or abuts with an outer wall of any interior structure of the electronic device 5), ensuring that the cover plate portion 12 of the fan frame 1 is spaced from the inner wall 51 of the electronic device 5 by a proper distance. Moreover, the impeller 3 has a permanent magnet that is driven by alternating magnetic fields generated by the coil unit 22 of the motor 2, triggering the rotation of the impeller 3. The principle on how the motor 2 drives the impeller 3 to rotate, as well as the detailed structures of the motor 2 and the impeller 3, are not described herein, as it would be readily appreciated by one having ordinary skill in the art.

When operating, the impeller 3 is able to draw the external air into the space between the inner wall 51 of the electronic device 5 and the cover plate portion 12 in a lateral direction. The air in the space is then guided into the fan frame 1 via the air inlet 121. Finally, the air in the fan frame 1 is guided to a predetermined location via the air outlet 131. As such, the centrifugal fan is able to provide a cooling function to a heat source of an electronic device when installed in the electronic device.

In the preferred embodiment, since each axial positioning member 4 has a predetermined length, it can be ensured that the distance between the cover plate portion 12 of the fan frame 1 and the inner wall 51 of the electronic device 5 will definitely be the second height H2 of each axial positioning member 4. As an example, when it is estimated that the cover plate portion 12 of the fan frame 1 is spaced from the inner wall 51 of the electronic device 5 by 10 cm, the second height H2 of the axial positioning member 4 may be designed as 10 cm. In this manner, the air inlet 121 of the centrifugal fan is able to be spaced from the inner wall of the electronic device by a proper distance as required when the centrifugal fan is installed in the electronic device. As a result, the centrifugal fan is able to draw sufficient air via the air inlet 121 without occupying a large space in the electronic device. This achieves various advantages such as the miniaturization and improved cooling effect of the centrifugal fan.

Moreover, based on the fact that the second height H2 may be defined as being 20% to 80% of the first height H1 (or 40% to 60% of the first height H1 as a preferred case), the distance between the cover plate portion 12 of the fan frame 1 and the inner wall 51 of the electronic device 5 may be further defined in a more accurate manner when the first height H1 of the fan frame 1 is properly chosen. Thus, the centrifugal fan is able to draw a proper amount of air, achieving a best balance between the cooling effect and the space occupancy of the centrifugal fan. Thus, convenient assembly and use of the centrifugal fan are achieved.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. A centrifugal fan comprising:

a fan frame comprising a base plate portion, a cover plate portion, and a lateral wall portion arranged between the base plate portion and the cover plate portion, wherein the cover plate portion comprises an air inlet, and wherein the lateral wall portion comprises an air outlet;

a motor received in the fan frame;

an impeller rotatably coupled with the motor, received in the fan frame and positioned intermediate the base and cover plate portions; and at least one axial positioning member arranged along a path surrounding and spaced radially outward from the air inlet and spaced radially inward from the lateral wall portion of the fan frame, wherein each of the at least one axial positioning member comprises a coupling face and an abutting face opposite to the coupling face, wherein the coupling face is coupled with the cover plate portion of the fan frame with the cover plate portion intermediate the coupling face and the impeller, and wherein the abutting face is spaced from the coupling face with the coupling face intermediate the abutting face and the cover plate portion.

2. The centrifugal fan as claimed in claim 1, wherein the fan frame has a first height in an axial direction of the fan frame, wherein each of the at least one axial positioning member has a second height in the axial direction of the fan frame, and wherein the second height is 20% to 80% of the first height.

3. The centrifugal fan as claimed in claim 2, wherein the second height is 40% to 60% of the first height.

4. The centrifugal fan as claimed in claim 1, wherein the at least one axial positioning member comprises a plurality of positioning members.

5. The centrifugal fan as claimed in claim 4, wherein each of the plurality of axial positioning members comprises a post.

6. The centrifugal fan as claimed in claim 5, wherein the posts of the plurality of positioning members are arranged along the path surrounding and radially outwardly of the air inlet of the fan frame, wherein the posts are spaced from each other by a plurality of gaps, and wherein the plurality of gaps forms a plurality of lateral air inlets.

7. The centrifugal fan as claimed in claim 4, wherein the plurality of axial positioning members comprises a first barrier and a second barrier opposing the first barrier.

8. The centrifugal fan as claimed in claim 7, wherein the first and second barriers are arranged along the path surrounding and radially outwardly of the air inlet of the fan frame, wherein each of the first and second barriers includes a first end and a second end, wherein an opening is formed between the first ends of the first and second barriers, wherein another opening is formed between the second ends of the first and second barriers, and wherein the two openings of the first and second barriers form two lateral air inlets.

9. The centrifugal fan as claimed in claim 8, wherein the first barrier is aligned with the air outlet of the fan frame in a radial direction of the fan frame, wherein an intake area is formed between the two openings and over the air inlet, and wherein the first barrier is positioned between the intake area and the air outlet of the fan frame in the radial direction of the fan frame.

10. The centrifugal fan as claimed in claim 4, wherein the at least one axial positioning member comprises at least one, post and at least one barrier.

11. The centrifugal fan as claimed in claim 10, wherein the at least one post and the at least one barrier are arranged along the path surrounding and radially outwardly of the air inlet of the fan frame.

12. The centrifugal fan as claimed in claim 1, wherein the at least one axial positioning member comprises a lateral wall surrounding the air inlet of the fan frame, wherein the lateral wall forms an opening, and wherein the opening acts as a lateral air inlet.

13. The centrifugal fan as claimed in claim 12, wherein the lateral wall is aligned with the air outlet of the fan frame in a radial direction of the fan frame, and wherein the lateral wall is located between the opening and the air outlet.

* * * * *